US011116683B2

(12) United States Patent
Connell et al.

(10) Patent No.: US 11,116,683 B2
(45) Date of Patent: Sep. 14, 2021

(54) LIFT ASSEMBLY FOR PATIENT SUPPORT APPARATUS

(71) Applicant: Stryker Corporation, Kalamazoo, MI (US)

(72) Inventors: Jason John Connell, London (CA); Joseph Steven David Elku, Tillsonburg (CA); Jeffrey C. Shiery, East Leroy, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 16/922,301

(22) Filed: Jul. 7, 2020

(65) Prior Publication Data

US 2020/0330306 A1 Oct. 22, 2020

Related U.S. Application Data

(63) Continuation of application No. 15/439,541, filed on Feb. 22, 2017, now Pat. No. 10,736,803.
(Continued)

(51) Int. Cl.
*A61G 1/04* (2006.01)
*A61G 7/10* (2006.01)
(Continued)

(52) U.S. Cl.
CPC ..... *A61G 7/1017* (2013.01); *A61G 1/013* (2013.01); *A61G 5/104* (2013.01); *A61G 7/012* (2013.01); *A61G 13/06* (2013.01); *A61G 1/00* (2013.01)

(58) Field of Classification Search
CPC ..... A61G 7/1017; A61G 7/012; A61G 1/013; A61G 1/04; A61G 5/104; A61G 13/06; A61G 1/00
See application file for complete search history.

(56) References Cited

U.S. PATENT DOCUMENTS 3,530,514 A 9/1970 McCalley
3,627,377 A 12/1971 Pickles
(Continued)

FOREIGN PATENT DOCUMENTS

DE 3313843 A1 10/1984
EP 364394 A2 4/1990
(Continued)

OTHER PUBLICATIONS

English language abstract and machine-assisted English translation for DE 33 13 843 extracted from espacenet.com database on Sep. 24, 2018, 12 pages.
(Continued)

*Primary Examiner* — Fredrick C Conley
(74) *Attorney, Agent, or Firm* — Howard & Howard Attorneys PLLC

(57) ABSTRACT

A patient support apparatus comprises a base and a support frame. The patient support apparatus also comprises a lift assembly that operates to lift and lower the support frame relative to the base. The lift assembly comprises lift members that extend and collapse to lift and lower the support frame. A timing link is pivotally connected to one of the lift members and pivotally connected to the base. Guides operate to guide movement of the lift members during operation. In some cases guided bodies coupled to the lift members move passively in the guides. In other embodiments, driven members coupled to the lift members move actively in the guides to cause lifting and lowering of the support frame.

20 Claims, 11 Drawing Sheets

Related U.S. Application Data

(60) Provisional application No. 62/300,454, filed on Feb. 26, 2016.

(51) Int. Cl.

| | |
|---|---|
| ***A61G 1/013*** | (2006.01) |
| ***A61G 5/10*** | (2006.01) |
| ***A61G 7/012*** | (2006.01) |
| ***A61G 13/06*** | (2006.01) |
| *A61G 1/00* | (2006.01) |

(56) References Cited

U.S. PATENT DOCUMENTS

| | | | |
|---|---|---|---|
| 4,747,212 | A | 5/1988 | Cavdek |
| 5,102,377 | A | 4/1992 | Spanski |
| 5,161,274 | A | 11/1992 | Hayes et al. |
| 5,355,743 | A | 10/1994 | Tesar |
| 5,613,255 | A | 3/1997 | Bish et al. |
| 6,071,228 | A | 6/2000 | Speraw et al. |
| 6,289,534 | B1 | 9/2001 | Hakamiun et al. |
| 6,421,854 | B1 | 7/2002 | Heimbrock |
| 6,611,979 | B2 | 9/2003 | Welling et al. |
| 6,659,935 | B2 | 12/2003 | Costanzo |
| 6,886,200 | B2 | 5/2005 | Blyshak et al. |
| 7,140,055 | B2 | 11/2006 | Bishop et al. |
| 7,150,056 | B2 | 12/2006 | Lemire |
| 7,171,708 | B2 | 2/2007 | Osborne et al. |
| 7,296,312 | B2 | 11/2007 | Menkedick et al. |
| 7,441,291 | B2 | 10/2008 | Hayes et al. |
| 7,454,805 | B2 | 11/2008 | Osborne et al. |
| 7,533,429 | B2 | 5/2009 | Menkedick et al. |
| 7,610,637 | B2 | 11/2009 | Menkedick et al. |
| 7,653,954 | B2 | 2/2010 | Hornbach et al. |
| 7,703,158 | B2 | 4/2010 | Wilker, Jr. et al. |
| 7,886,380 | B2 | 2/2011 | Hornbach et al. |
| 7,913,335 | B2 | 3/2011 | Carr |
| 7,926,131 | B2 | 4/2011 | Menkedick et al. |
| 8,074,309 | B2 | 12/2011 | Hutchison et al. |
| 8,104,120 | B2 | 1/2012 | Hornbach et al. |
| RE43,193 | E | 2/2012 | Osborne et al. |
| 8,151,387 | B2 | 4/2012 | Osborne et al. |
| 8,176,584 | B2 | 5/2012 | Hornbach et al. |
| 8,256,048 | B2 | 9/2012 | Bly et al. |
| 8,291,532 | B2 | 10/2012 | Hornbach et al. |
| 8,321,976 | B1 | 12/2012 | Edgerton |
| 8,458,833 | B2 | 6/2013 | Hornbach et al. |
| 8,502,663 | B2 | 8/2013 | Riley et al. |
| 8,607,384 | B2 | 12/2013 | Hornbach |
| 8,621,690 | B2 | 1/2014 | Hornbach et al. |
| 8,844,078 | B2 | 9/2014 | Hornbach et al. |
| 9,227,822 | B2 | 1/2016 | Horne |
| 10,736,803 | B2 | 8/2020 | Elku et al. |
| 2002/0178502 | A1 | 12/2002 | Beasley et al. |
| 2004/0055087 | A1 | 3/2004 | Edgerton |
| 2006/0021143 | A1* | 2/2006 | Lemire ..... A61G 7/012 5/611 |
| 2010/0000017 | A1 | 1/2010 | Laloge et al. |
| 2010/0199433 | A1 | 8/2010 | Clenet |
| 2012/0124746 | A1 | 5/2012 | Andrienko et al. |
| 2014/0033435 | A1 | 2/2014 | Jutras |
| 2014/0041120 | A1 | 2/2014 | Li |
| 2014/0189954 | A1 | 7/2014 | Lee |
| 2014/0325759 | A1 | 11/2014 | Bly et al. |
| 2016/0136021 | A1 | 5/2016 | Roussy et al. |
| 2016/0302985 | A1 | 10/2016 | Tessmer et al. |
| 2018/0214326 | A1 | 8/2018 | Lacasse et al. |
| 2018/0360681 | A1* | 12/2018 | Paul ..... A61G 7/015 |

FOREIGN PATENT DOCUMENTS

| | | | |
|---|---|---|---|
| EP | 0736275 | A1 | 10/1996 |
| JP | H02156950 | A | 8/1990 |
| KR | 20140003301 | A | 1/2014 |
| TR | 201408650 | | 1/2015 |
| WO | 1996029970 | A1 | 10/1996 |
| WO | 0117399 | A1 | 3/2001 |
| WO | 0117400 | A1 | 3/2001 |
| WO | 0123847 | A1 | 4/2001 |
| WO | 2007069912 | A1 | 6/2007 |
| WO | 2013066198 | A1 | 5/2013 |
| WO | 2014150652 | A1 | 9/2014 |
| WO | 2014191684 | A1 | 12/2014 |
| WO | 2015032003 | A1 | 3/2015 |

OTHER PUBLICATIONS

English language abstract and machine-assisted English translation for EP 0 364 394 extracted from espacenet.com database on Sep. 26, 2018, 12 pages.

English language abstract and machine-assisted English translation for JPH 02-156950 extracted from espacenet.com database Sep. 24, 2018, 7 pages.

English language abstract and machine-assisted English translation for WO 2014/191684 extracted from espacenet.com database on Sep. 26, 2018, 14 pages.

English language abstract and machine-assisted translation for for KR20140003301 extracted from espacenet.com on Oct. 24, 2017; 5 pages.

Stryker Bertec Medical Inc., "The Go Bed Electric Acute Care Bed Maintenance Manual", Dec. 2000, pp. 1-64.

Stryker Bertec Medical Inc., "The Go Bed Electric Acute Care Bed Operations Manual", Sep. 2002, pp. 1-20.

* cited by examiner

LIFT ASSEMBLY FOR PATIENT SUPPORT APPARATUS

RELATED APPLICATIONS

This application is a continuation of U.S. patent application Ser. No. 15/439,541, filed on Feb. 22, 2017, which claims the benefit of and priority to U.S. Provisional Patent Application No. 62/300,454, filed on Feb. 26, 2016, the entire contents and disclosures of each of which are hereby incorporated by reference in their entirety.

BACKGROUND

Patient support apparatuses, such as hospital beds, stretchers, cots, tables, and wheelchairs, facilitate care of patients in a health care setting. Conventional patient support apparatuses comprise a base, a support frame upon which the patient is supported, and a lift assembly for lifting and lowering the support frame relative to the base. Sometimes, it is desirable for the lift assembly to be capable of moving the support frame to a minimum height that eases ingress and egress of the patient and a maximum height that eases access to patients by caregivers. However, limitations on where a typical lift assembly can be placed on a patient support apparatus, due to the large amount of space required, often make providing a suitable range between the minimum height and the maximum height difficult. For instance, a typical lift assembly utilizes space-consuming linear actuators and lift legs to lift and lower the support frame relative to the base.

A patient support apparatus with a lift assembly designed to overcome one or more of the aforementioned disadvantages is desired.

DETAILED DESCRIPTION

Figure 1:
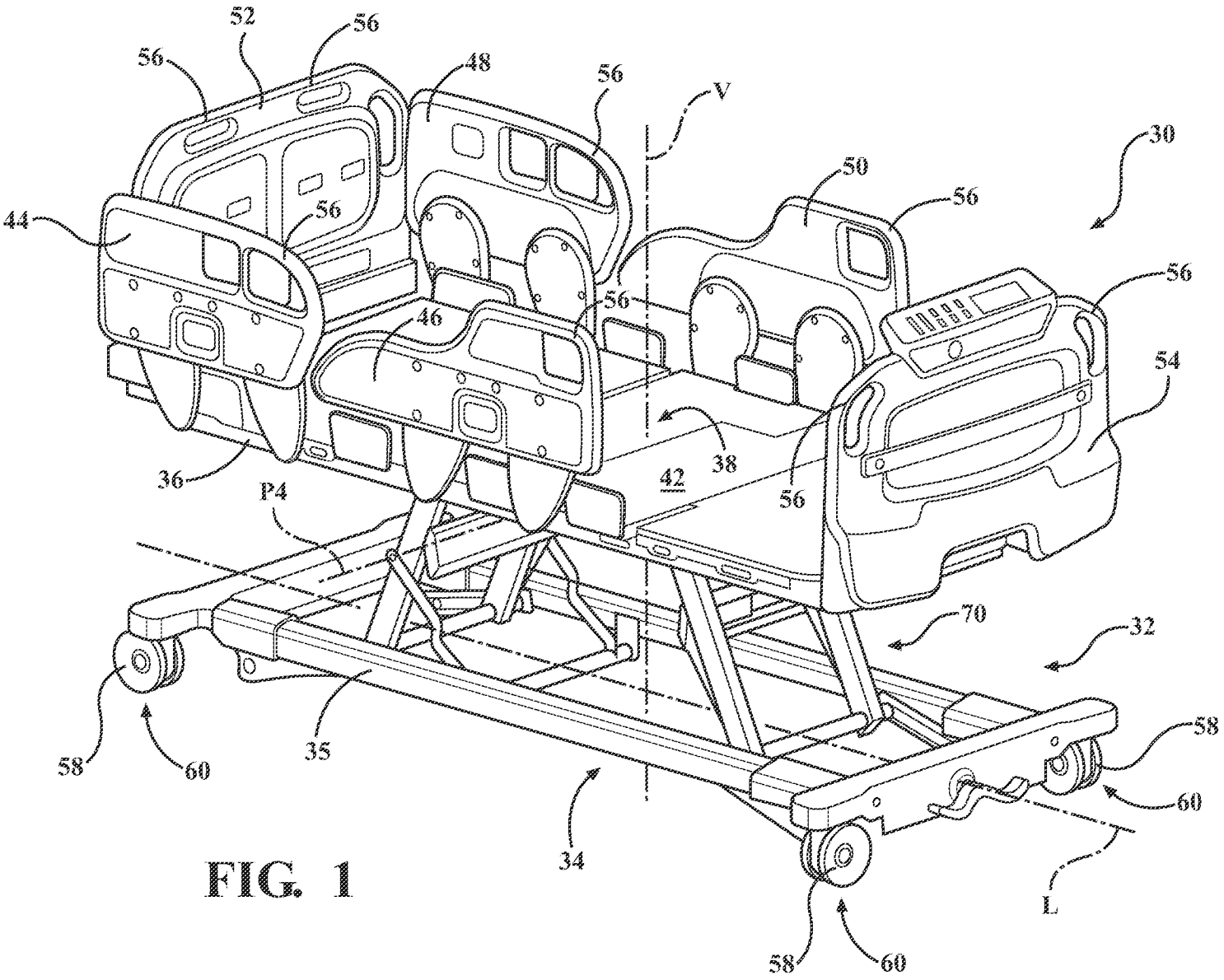
FIG. 1 is perspective view of a patient support apparatus.

Referring to FIG. 1, a patient support apparatus 30 is shown for supporting a patient in a health care setting. The patient support apparatus 30 illustrated in FIG. 1 comprises a hospital bed. In other embodiments, however, the patient support apparatus 30 may comprise a stretcher, cot, table, wheelchair, or similar apparatus utilized in the care of a patient.

A support structure 32 provides support for the patient. The support structure 32 illustrated in FIG. 1 comprises a base 34 and a support frame 36. The base 34 comprises a base frame 35. The support frame 36 is spaced above the base frame 35 in FIG. 1. The support structure 32 also comprises a patient support deck 38 disposed on the support frame 36. The patient support deck 38 comprises several sections, some of which are pivotable relative to the support frame 36, such as a fowler section, a seat section, a thigh section, and a foot section. The patient support deck 38 provides a patient support surface 42 upon which the patient is supported.

A mattress (not shown) is disposed on the patient support deck 38 during use. The mattress comprises a secondary patient support surface upon which the patient is supported. The base 34, support frame 36, patient support deck 38, and patient support surfaces 42 each have a head end and a foot end corresponding to designated placement of the patient's head and feet on the patient support apparatus 30. The base 34 comprises a longitudinal axis L along its length from the head end to the foot end. The base 34 also comprises a vertical axis V arranged crosswise (e.g., perpendicularly) to the longitudinal axis L along which the support frame 36 is lifted and lowered relative to the base 34. The construction of the support structure 32 may take on any known or conventional design, and is not limited to that specifically set forth above. In addition, the mattress may be omitted in certain embodiments, such that the patient rests directly on the patient support surface 42.

Side rails 44, 46, 48, 50 are coupled to the support frame 36 and thereby supported by the base 34. A first side rail 44 is positioned at a right head end of the support frame 36. A second side rail 46 is positioned at a right foot end of the support frame 36. A third side rail 48 is positioned at a left head end of the support frame 36. A fourth side rail 50 is positioned at a left foot end of the support frame 36. If the patient support apparatus 30 is a stretcher or a cot, there may be fewer side rails. The side rails 44, 46, 48, 50 are movable between a raised position in which they block ingress and egress into and out of the patient support apparatus 30, one or more intermediate positions, and a lowered position in which they are not an obstacle to such ingress and egress. In still other configurations, the patient support apparatus 30 may not include any side rails.

A headboard 52 and a footboard 54 are coupled to the support frame 36. In other embodiments, when the headboard 52 and footboard 54 are included, the headboard 52 and footboard 54 may be coupled to other locations on the patient support apparatus 30, such as the base 34. In still other embodiments, the patient support apparatus 30 does not include the headboard 52 and/or the footboard 54.

Caregiver interfaces 56, such as handles, are shown integrated into the footboard 54 and side rails 44, 46, 48, 50 to facilitate movement of the patient support apparatus 30 over floor surfaces. Additional caregiver interfaces 56 may be integrated into the headboard 52 and/or other components of the patient support apparatus 30. The caregiver interfaces 56 are graspable by the caregiver to manipulate the patient support apparatus 30 for movement.

Other forms of the caregiver interface 56 are also contemplated. The caregiver interface may comprise one or more handles coupled to the support frame 36. The caregiver interface may simply be a surface on the patient support apparatus 30 upon which the caregiver logically applies force to cause movement of the patient support apparatus 30 in one or more directions, also referred to as a push location. This may comprise one or more surfaces on the support frame 36 or base 34. This could also comprise one or more surfaces on or adjacent to the headboard 52, footboard 54, and/or side rails 44, 46, 48, 50. In other embodiments, the caregiver interface may comprise separate handles for each hand of the caregiver. For example, the caregiver interface may comprise two handles.

Wheels 58 are coupled to the base 34 to facilitate transport over the floor surfaces. The wheels 58 are arranged in each of four quadrants of the base 34 adjacent to corners of the base 34. In the embodiment shown, the wheels 58 are caster wheels able to rotate and swivel relative to the support structure 32 during transport. Each of the wheels 58 forms part of a caster assembly 60. Each caster assembly 60 is mounted to the base 34. It should be understood that various configurations of the caster assemblies 60 are contemplated. In addition, in some embodiments, the wheels 58 are not caster wheels and may be non-steerable, steerable, non-powered, powered, or combinations thereof. Additional wheels are also contemplated. For example, the patient support apparatus 30 may comprise four non-powered, non-steerable wheels, along with one or more powered wheels. In some cases, the patient support apparatus 30 may not include any wheels.

In other embodiments, one or more auxiliary wheels (powered or non-powered), which are movable between stowed positions and deployed positions, may be coupled to the support structure 32. In some cases, when these auxiliary wheels are located between caster assemblies 60 and contact the floor surface in the deployed position, they cause two of the caster assemblies 60 to be lifted off the floor surface thereby shortening a wheel base of the patient support apparatus 30. A fifth wheel may also be arranged substantially in a center of the base 34.

Figure 2:
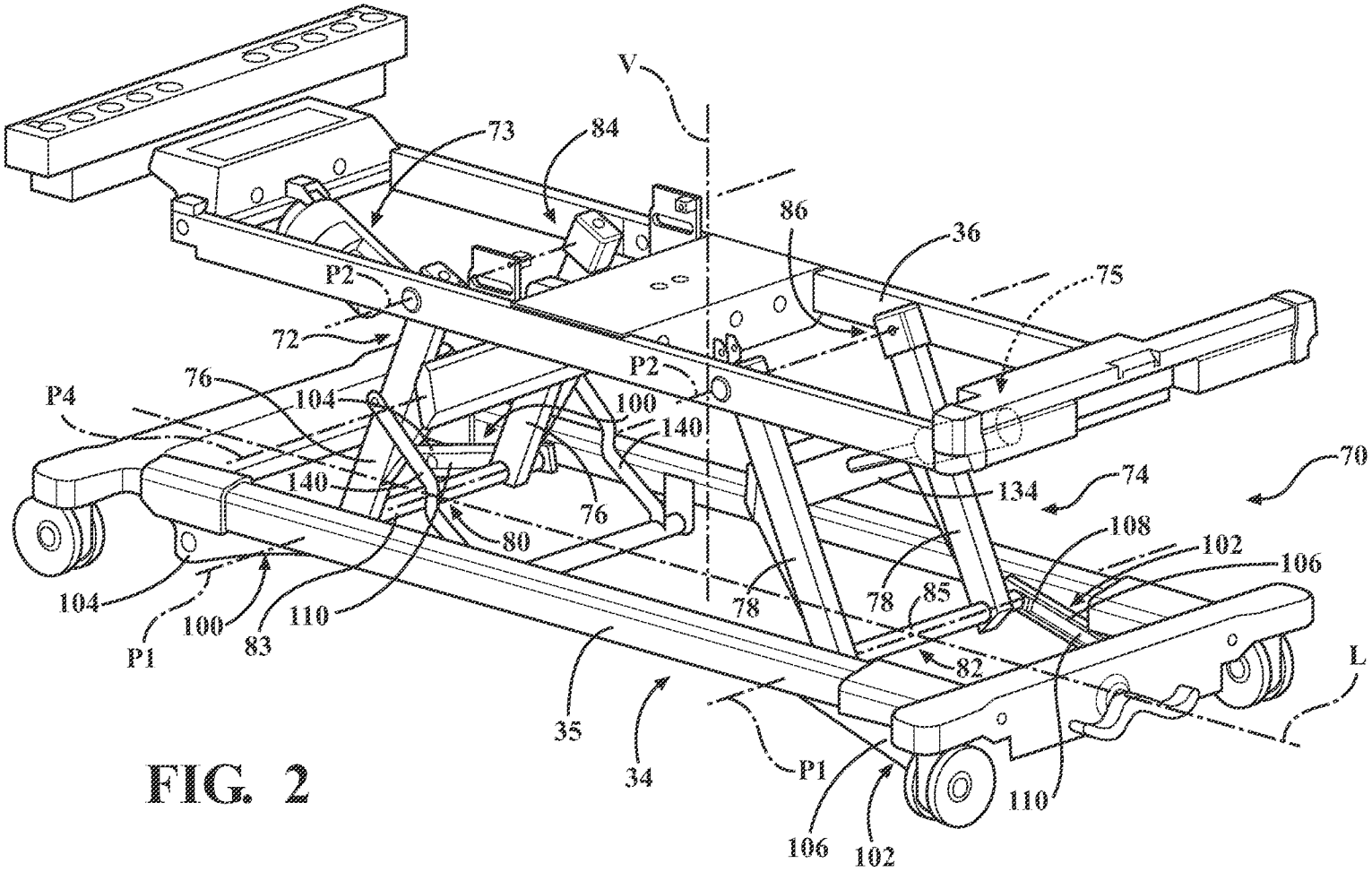
FIG. 2 is a perspective view of a lift assembly of the patient support apparatus at a maximum height.
Figure 3:
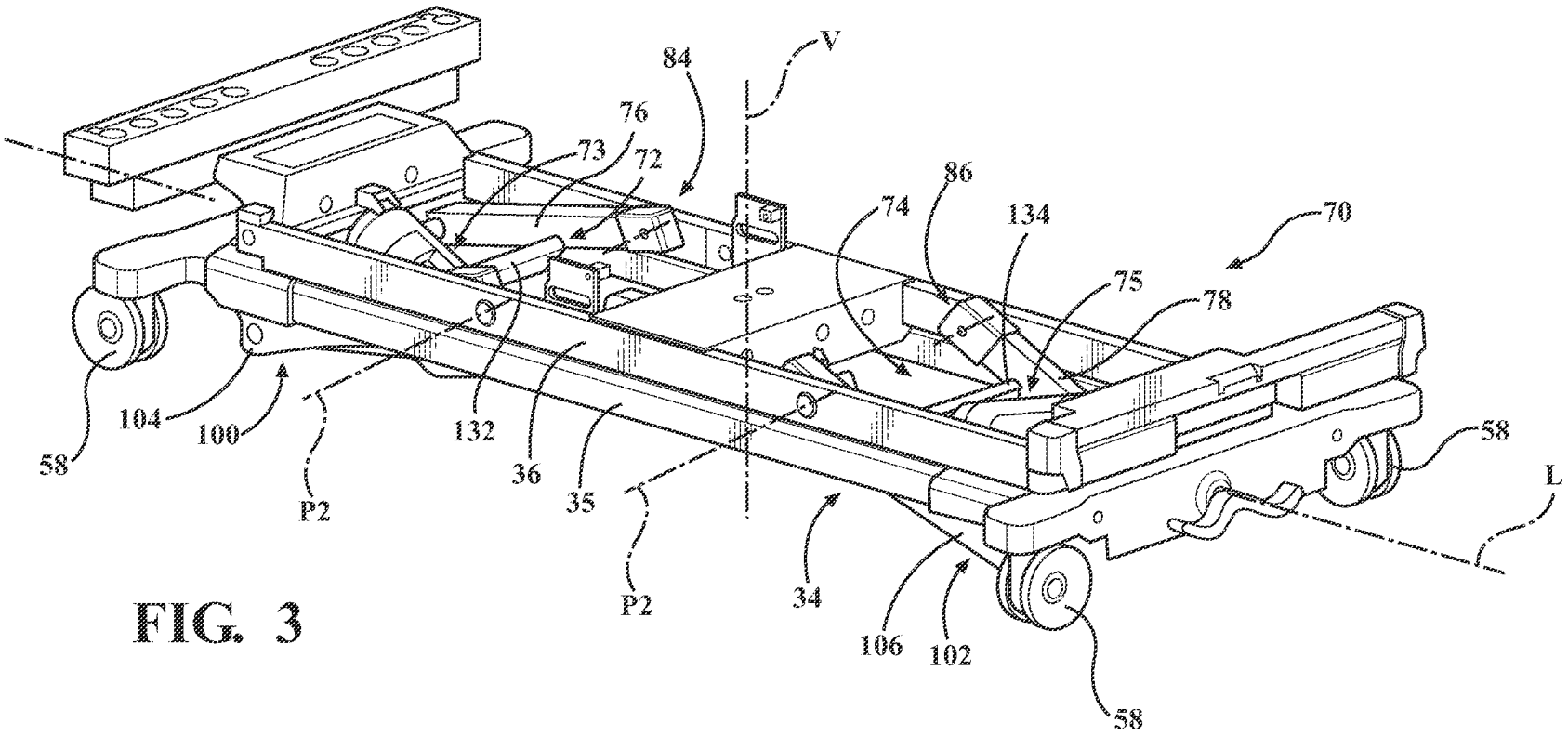
FIG. 3 is a perspective view of the lift assembly of the patient support apparatus at a minimum height.

Referring to FIGS. 2 and 3, the patient support apparatus 30 comprises a lift assembly 70 that operates to lift and lower the support frame 36 relative to the base 34. The lift assembly 70 is configured to move the support frame 36 from a minimum height (shown in FIG. 3) to a maximum height (shown in FIG. 2), or to any desired position in between.

The lift assembly 70 comprises head end and foot end lift members 72, 74. First and second actuators 73, 75 (see also FIG. 5) move the lift members 72, 74 to lift and lower the support frame 36 relative to the base 34. The first actuator 73 is coupled to the head end lift member 72. The second actuator 75 is coupled to the foot end lift member 74. The actuators 73, 75 operate to pivot their respective lift member 72, 74 about fixed upper pivot axes P2 to lift and lower the support frame 36 relative to the base 34, as described further below. The actuators 73, 75 comprise linear actuators, rotary actuators, or other types of actuators. The actuators 73, 75 may be electrically operated and/or may be hydraulic. In the embodiment shown, the actuators 73, 75 are electro-hydraulic, linear actuators, such as compact electro-hydraulic actuators available from Parker Hannifin Corp., Marysville, Ohio, e.g., Part No. 649346. In other embodiments, the actuators 73, 75 can be electric, linear actuators. It is contemplated that, in some embodiments, only one lift member and one associated actuator may be employed, e.g., to raise only one end of the support frame 36.

The lift members 72, 74 comprise a pair of head end lift legs 76 and a pair of foot end lift legs 78 pivoted by the actuators 73, 75 about the fixed upper pivot axes P2. In other embodiments, each of the lift members 72, 74 may comprise a single lift leg. In still other embodiments, other types of lifting members capable of lifting and lowering the support frame 36 may be employed. The lift members 72, 74 may be identical in form or may have different forms. For instance, one of the lift members 72, 74 may be a single lift leg, while the other of the lift members 72, 74 may comprise part of a scissor-type mechanism. It should be appreciated that each of the lift members 72, 74 may be formed in a unitary construction or may be separate pieces fastened together.

The lift members 72, 74 comprise first end sections 80, 82 movably coupled to the base 34. In particular, the first end sections 80, 82 are connected to guided bodies 108 (see FIG. 4) that slide in head end and foot end guides 100, 102 relative to the base 34 during the lifting and lowering of the support frame 36, i.e., when the actuators 73, 75 pivot the lift members 72, 74 about the fixed upper pivot axes P2. In the embodiment shown, the first end sections 80, 82 comprise first ends of the lift legs 76, 78 and a support member 83, 85 interconnecting each pair of the lift legs 76, 78, respectively, at their first ends. In the embodiment shown, the support members 83, 85 are rigidly fixed to the lift legs 76, 78 to move with the lift legs 76, 78. The support members 83, 85 define a moving lower pivot axis P1 about which the support members 83, 85 pivot as the first end sections 80, 82 slide relative to the base 34. In other embodiments, the lift legs 76, 78 may pivot relative to the support members 83, 85.

The lift members 72, 74 extend from the first end sections 80, 82 to second end sections 84, 86. The second end sections 84, 86 are pivotally connected to the support frame 36 at the fixed upper pivot axes P2 for pivoting relative to the support frame 36. In the embodiment shown, the second end sections 84, 86 comprise second ends of the lift legs 76, 78. The fixed upper pivot axes P2 lie in a common plane perpendicular to the vertical direction when the support frame 36 is at the minimum height or the maximum height.

The guides 100, 102 are arranged to guide the movement of the first end sections 80, 82 when the actuators 73, 75 pivot the lift members 72, 74 about the fixed upper pivot axes P2 to lift and lower the support frame 36 relative to the base 34. The head end guides 100 guide movement of the head end lift member 72. The foot end guides 102 guide movement of the foot end lift member 74. In the embodiment shown, four guides 100, 102 are provided. The four guides 100, 102 comprise a pair of head end guide tracks 104 and a pair of foot end guide tracks 106. The guide tracks 104, 106 are fixed to the base 34 and have a hollow, elongated shape. In particular, the guide tracks 104, 106 are shown being formed of rectangular tubing. In other embodiments, the guides 100, 102 may assume other forms or shapes capable of guiding movement of the first end sections 80, 82 of the lift members 72, 74.

Figure 4:
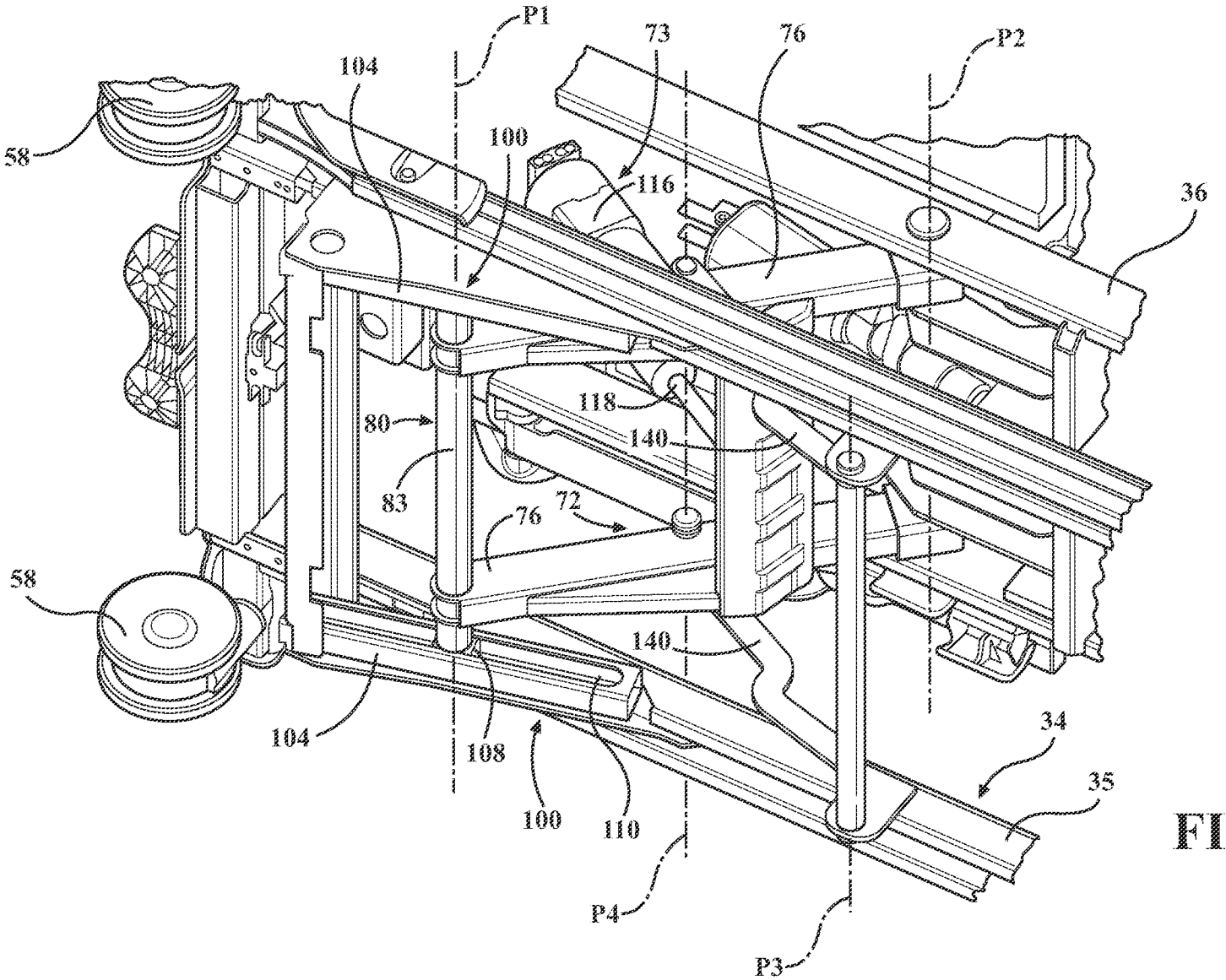
FIG. 4 is a perspective view of a portion of the lift assembly.

Referring to FIG. 4, the guided bodies 108 are rotatably coupled to the lift members 72, 74 to rotate relative to the lift members 72, 74 when sliding in the guides 100, 102. More specifically, the guided bodies 108 are rotatably connected at each end of the support members 83, 85 to pivot about the lower pivot axes P1 as the guided bodies 108 slide in the guide tracks 104, 106. The guided bodies 108 are captured in the guide tracks 104, 106 to prevent withdrawal. In the embodiment shown, the guided bodies 108 comprise blocks and the guide tracks 104, 106 comprise slide-bearing guide tracks in which the blocks slide. The blocks can be any shape, including box-shaped, spherical, cylindrical, or the like. In other embodiments, the guided bodies 108 comprise rollers, gears, or other movable elements. In further embodiments, the guide tracks 104, 106 comprise racks and the guided bodies 108 comprise gears movable along the racks.

The guide tracks 104, 106 comprise guide slots 110 through which the support members 83, 85 are rotatably connected to the guided bodies 108. The guide slots 110 are shaped to be at least one of linear or arcuate. In the embodiment shown, the guide slots 110 are linear. In some embodiments, the guide slots 110 have a linear portion and an arcuate portion. In still other embodiments, the guide slots 110 are formed with other shapes. The shape of the guide tracks 104, 106 and the guide slots 110 dictate the path along which the support members 83, 85, and by extension, the first end sections 80, 82, follow during movement of the lift members 72, 74.

Figure 5:
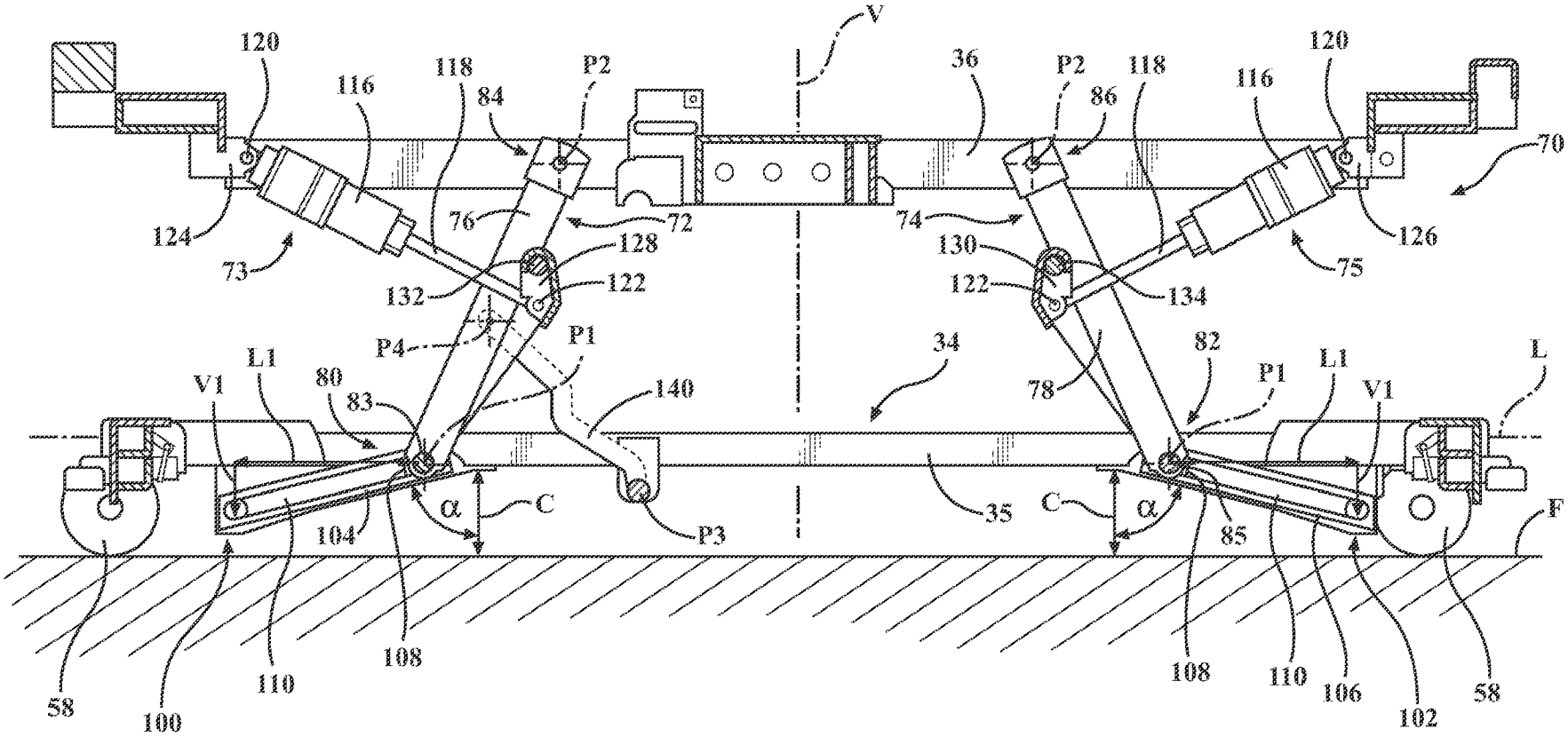
FIG. 5 is a cross-sectional and elevational view of the lift assembly at the maximum height.
Figure 6:
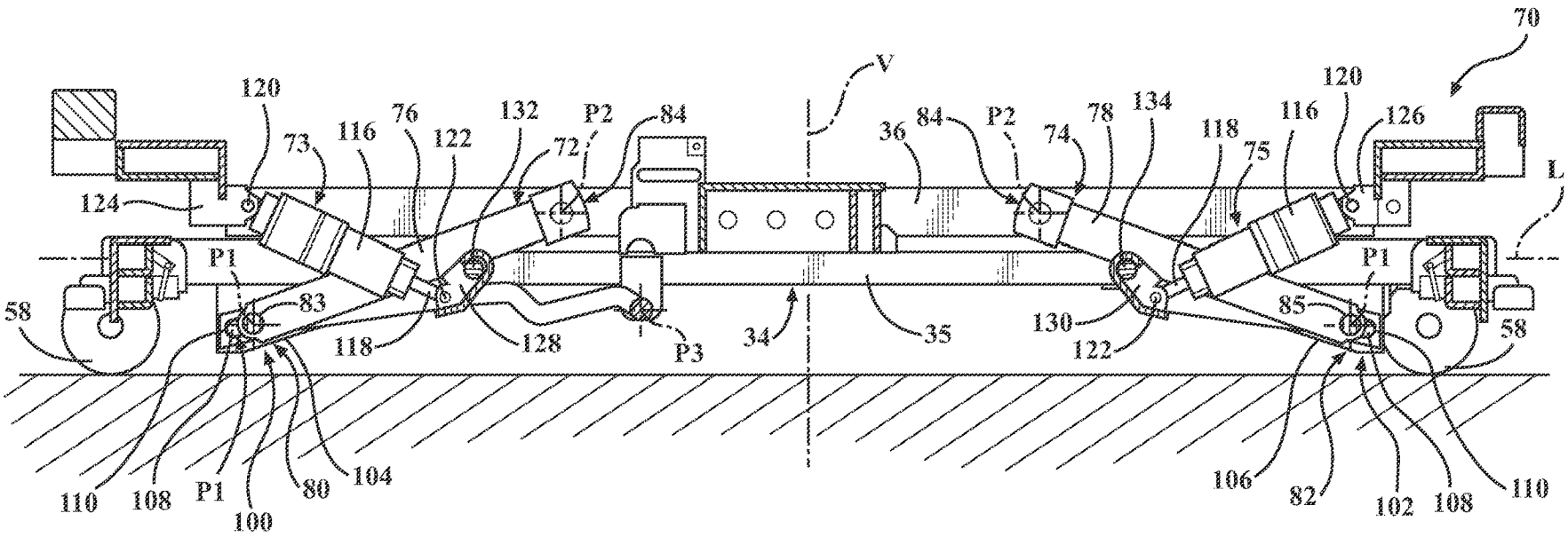
FIG. 6 is a cross-sectional and elevational view of the lift assembly at the minimum height.

Referring to FIG. 5, the guide tracks 104, 106 are obliquely oriented (e.g., askew) with respect to the base 34 and the vertical axis V when the support frame 36 is at the minimum height or the maximum height. More specifically, the guide tracks 104, 106 may be oriented at an acute angle $\alpha$ to the vertical axis V of more than 0 degrees and less than 90 degrees, from 1 degree to 89 degrees, from 5 degrees to 85 degrees, from 10 degrees to 80 degrees, from 20 degrees to 70 degrees, from 30 degrees to 60 degrees, from 40 degrees to 50 degrees, or between 0 degrees and 90 degrees. The guide tracks 104, 106 are fixed to the base frame 35 so that one end of the guide tracks 104, 106 extends below the base frame 35. As a result, the support members 83, 85, and by extension, the first end sections 80, 82, extend below the base frame 35 when the support frame 36 is at the minimum height (see FIG. 6). As a result of this orientation, clearance C is provided between the guides 100, 102 and a floor surface F. The clearance is at least five inches between at least a portion of the guide tracks 104, 106 and the floor surface F. In other embodiments, the clearance may be greater than five, six, seven, eight, nine, or ten inches. In still other embodiments, the clearance is no greater than five, six, seven, eight, nine, or ten inches.

Owing to the fixed upper pivot axes P2, the support frame 36 is fixed from moving longitudinally or vertically relative to the second end sections 84, 86 as the support frame 36 is lifted or lowered relative to the base 34. Conversely, owing to the oblique orientation of the guide tracks 104, 106, the first end sections 80, 82 are longitudinally and vertically displaced relative to the base 34 when the actuators 73, 75 pivot the lift members 72, 74 about the fixed upper pivot axes P2. More specifically, for instance when lowering the support frame 36, the first end sections 80, 82 are longitudinally displaced by a longitudinal distance L1 and vertically displaced by a vertical distance V1. By virtue of their arrangement, the guide tracks 104, 106 and the guided bodies 108 cooperate in a manner that contribute to the lifting and lowering of the support frame 36 relative to the base 34. In other words, owing to the oblique orientation of the guide tracks 104, 106 relative to the vertical axis V, when the first end sections 80, 82 move in the guide tracks 104, 106, the lift members 72, 74 lift or lower relative to the base 34. This additional lifting or lowering of the lift members 72, 74 enhances the range between the maximum height and the minimum height.

The guide tracks 104, 106 and the lift members 72, 74 are arranged so that the first end sections 80, 82 move toward one another as the support frame 36 is lifted relative to the base 34 and the first end sections 80, 82 move away from one another as the support frame 36 is lowered relative to the base 34.

In the embodiment shown, each of the actuators 73, 75 comprises a housing 116 and a drive rod 118 that extends and retracts relative to the housing 116 to pivot the lift members 72, 74 about their fixed upper pivot axes P2. The actuators 73, 75 have a housing end 120 that is pivotally connected to the support frame 36. The actuators 73, 75 extend from the housing end 120 to a rod end 122 that is pivotally connected to the lift members 72, 74. The actuators 73, 75 are pivotally connected to the support frame 36 and the lift members 72, 74 at actuator mounts.

In the embodiment shown, the actuator mounts comprise pivot brackets 124, 126, 128, 130. Two of the pivot brackets 124, 126, 128, 130 are fixed to the support frame 36 to support the housing ends 120. In particular, one pivot bracket 124 is fixed to the support frame 36 to which the housing end 120 of the first actuator 73 is pivotally connected by a pivot element, such as a pivot pin. Another pivot bracket 126 is fixed to the support frame 36 to which the housing end 120 of the second actuator 75 is pivotally connected by a pivot element, such as a pivot pin.

The other two of the pivot brackets 124, 126, 128, 130 are fixed to the lift members 72, 74 to support the rod ends 122. In particular, one pivot bracket 128 is coupled to the head end lift member 72. Another pivot bracket 130 is coupled to the foot end lift member 74. These pivot brackets 128, 130 are fixed to cross links 132, 134 that interconnect each pair of the head end and foot end lift legs 76, 78 about midway along a length of the lift legs 76, 78. The rod end 122 of the first actuator 73 is pivotally connected to the pivot bracket 128. The rod end 122 of the second actuator 75 is pivotally connected to the other pivot bracket 130. The rod ends 122 are pivotally connected to the lift members 72, 74 so that as the actuators 73, 75 are operated, the rod ends 122 extend and retract relative the housings 116 to move (e.g., pivot) the lift members 72, 74 and lift and lower the support frame 36 relative to the base 34.

Timing links 140 are pivotally connected at a first end to one of the lift legs 76, 78 and pivotally connected at a second end to the base frame 35. In particular, in the embodiment shown, two timing links 140 are pivotally connected to the base frame 35 to pivot about a third pivot axis P3 and are pivotally connected to the head end lift legs 76 to pivot about a fourth pivot axis P4. In the embodiment shown, the ends of the timing links 140 pivotally connected to the base frame 35 are pivotally connected to brackets fixed to the base frame 35 that extend below the base frame 35. This arrangement enables the lift members 72, 74 to further collapse when moving to the minimum height. Torsion springs could be added at pivot axes P2, P4 for smoother lifting and lowering of the support frame 36.

Additional timing links 140 could also be pivotally connected to the foot end lift legs 78 in other embodiments. The timing links 140 constrain movement of the head end lift legs 76 during lifting and lowering so that, when the actuators 73, 75 are operated simultaneously to lift and lower the support frame 36, the head end and the foot end of the support frame 36 are lifted and lowered evenly relative to the base 34 without any relative longitudinal motion between the support frame 36 and the base 34. The actuators 73, 75 can also be operated independently to place the support frame 36 in a Trendelenburg or reverse Trendelenburg position.

A control system (not shown) is provided to control operation of the actuators 73, 75. The control system comprises a controller having one or more microprocessors for processing instructions or for processing an algorithm stored in memory to control operation of the actuators 73, 75 to coordinate movement of the actuators 73, 75 to evenly lift and lower the support frame 36 relative to the base 34 or to independently operate the actuators 73, 75 to place the support frame 36 in the Trendelenburg or reverse Trendelenburg positions.

Additionally or alternatively, the controller may comprise one or more microcontrollers, field programmable gate arrays, systems on a chip, discrete circuitry, and/or other suitable hardware, software, or firmware that is capable of carrying out the functions described herein. The controller may be carried on-board the patient support apparatus 30, or may be remotely located. In one embodiment, the controller is mounted to the base 34. In other embodiments, the controller is mounted to the footboard 54. Power to the actuators 73, 75 and/or the controller may be provided by a battery power supply or an external power source.

The controller is coupled to the actuators 73, 75 in a manner that allows the controller to control the actuators 73, 75. The controller may communicate with the actuators 73, 75 via wired or wireless connections to perform one of more desired functions.

The controller may monitor a current state of the actuators 73, 75 and determine desired states in which the actuators 73, 75 should be placed, based on one or more input signals that the controller receives from one or more input devices. The state of the actuators 73, 75 may be a position, a relative position, an angle, an energization status (e.g., on/off), or any other parameter of the actuators 73, 75.

The user, such as a caregiver, may actuate a user input device (not shown), which transmits a corresponding input signal to the controller, and the controller controls operation of the actuators 73, 75 based on the input signal. The user input devices may comprise any device capable of being actuated by the user. The user input devices may be configured to be actuated in a variety of different ways, including but not limited to, mechanical actuation (hand, foot, finger, etc.), hands-free actuation (voice, foot, etc.), and the like. The user input devices may comprise buttons (such as buttons corresponding to lift, lower, Trendelenburg, and reverse Trendelenburg), a gesture sensing device for monitoring motion of hands, feet, or other body parts of the user (such as through a camera), a microphone for receiving voice activation commands, a foot pedal, and a sensor (e.g., infrared sensor such as a light bar or light beam to sense a user's body part, ultrasonic sensor, etc.). Additionally, the buttons/pedals can be physical buttons/pedals or virtually implemented buttons/pedals such as through optical projection or on a touchscreen. The buttons/pedals may also be mechanically connected or drive-by-wire type buttons/pedals where a user applied force actuates a sensor, such as a switch or potentiometer. It should be appreciated that any combination of user input devices may also be utilized. The user input devices may be located on one of the side rails 44, 46, 48, 50, the headboard 52, the footboard 54, or other suitable locations. The user input devices may also be located on a portable electronic device (e.g., iWatch®, iPhone®, iPad®, or similar electronic devices).

During operation, when a user wishes to move the support frame 36 relative to the base 34, the user actuates one or more of the user input devices. For instance, in the event the user wishes to lower the support frame 36 relative to the base 34, such as moving the support frame 36 from the position shown in FIG. 5 to the position shown in FIG. 6, the user actuates the appropriate user input device. Upon actuation, the controller sends output signals to the actuators 73, 75 to cause operation of the actuators 73, 75 in a manner that causes the support frame 36 to lower. In the embodiment shown, this includes both of the actuators 73, 75 being commanded by the controller to retract their associated drive rods 118 into the housings 116. As a result, owing to the pivotal connection of the rod ends 122 to the lift members 72, 74, each of the lift members 72, 74 pivots about their respective fixed upper pivot axis P2 so that the first end sections 80, 82 of the lift members 72, 74 begin to move away from one another while being guided by the guides 100, 102. In other embodiments, the pivot axes P2 and guides 100 may be located so that the first end sections 80, 82 move toward one another when lowering the support frame 36 relative to the base 34, such as when the pivot axes P2 are located more toward the head and foot ends of the support frame 36 and the guides 100 are located more toward a center of the base 34.

Due to the oblique orientation of the guide tracks 104, 106 relative to the vertical axis V, as the first end sections 80, 82 move away from one another, the guided bodies 108 are slidably guided in the guide tracks 104, 106 such that the guided bodies 108 move both longitudinally and vertically, up to the entire longitudinal distance L1 and the vertical distance V1. More specifically, the guided bodies 108 that are coupled to the head end lift member 72 move longitudinally toward the head end of the base 34 and the guided bodies 108 that are coupled to the foot end lift member 74 move longitudinally toward the foot end of the base 34, while all of the guided bodies 108 move equally vertically downward. By guiding the guided bodies 108 to move vertically downward, the lift members 72, 74 are lowered, thereby further lowering the support frame 36 to which the lift members 72, 74 are pivotally constrained. This provides an even lower minimum height of the support frame 36 than could otherwise be accomplished if the guide tracks 104, 106 were merely arranged longitudinally along the base, e.g., not oblique.

Figure 7:
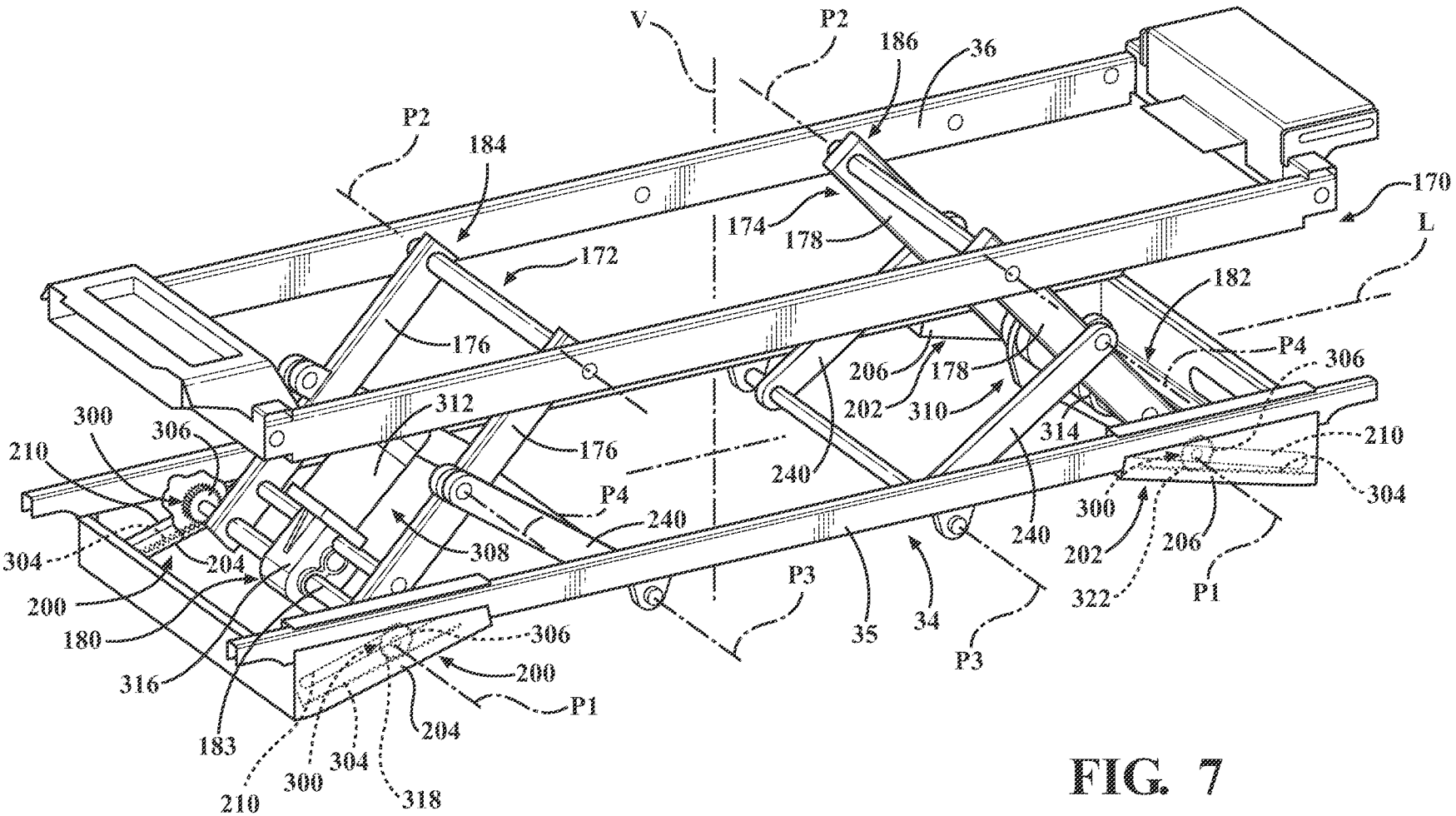
FIG. 7 is a perspective view of an alternative lift assembly of the patient support apparatus.
Figure 8:
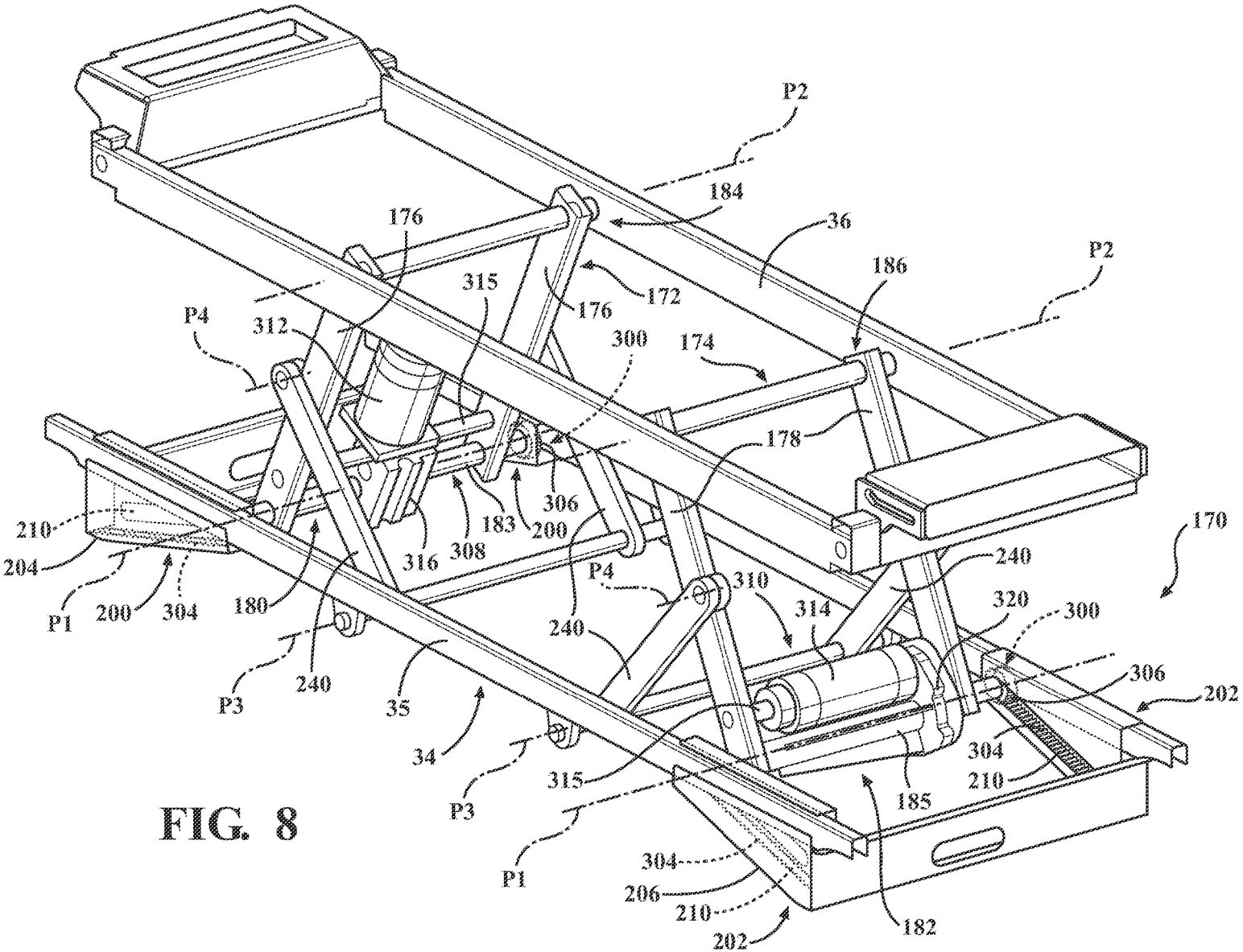
FIG. 8 is another perspective view of the alternative lift assembly of the patient support apparatus.

Referring to FIGS. 7 and 8, an alternative lift assembly 170 is shown. The alternative lift assembly 170 is substantially similar to the lift assembly 70. In the lift assembly 170, the numerals are increased by 100 to refer to similar parts as the previously described lift assembly 70. One difference between the lift assemblies 70 and 170 is that the lift assembly 170 comprises driven members 300 that engage guides 200, 202 in place of the guided bodies 108 that are guided in the guides 100, 102 of the previous embodiments. Unlike the previously described embodiments in which the guided bodies 108 are passive and slide within the guides 100, 102 as a result of actuation of the actuators 73, 75, the driven members 300 are active and are driven by rotary actuators 308, 310 to move in the guides 200, 202. In other words, the driven members 300, 302 are configured to engage and cooperate with the guides 200, 202 to lift and lower the support frame 36 relative to the base 34. Also in this embodiment, crossbars (not numbered) extend between the lift legs 176, 178 at pivots axes P2, but may be absent as in the prior described embodiments.

The guides 200, 202 comprise a pair of head end guide tracks 204 and a pair of foot end guide tracks 206. The head end guide tracks 204, as in the prior described embodiments, guide movement of a head end lift member 172 comprising a pair of head end lift legs 176 as the head end lift member 172 pivots about a fixed upper pivot axis P2. The foot end guide tracks 206 similarly guide movement of a foot end lift member 174 comprising a pair of foot end lift legs 178 as the foot end lift member 174 pivots about a fixed upper pivot axis P2. The lift members 172, 174 move as a result of the driven members 300, 302 being driven in the guide tracks 204, 206 in order to lift and lower the support frame 36 relative to the base 34.

In the embodiment shown, the guide tracks 204, 206 are fixed to the base 34. In other embodiments, the guide tracks 204, 206 are fixed to the support frame 36. In the embodiment shown, the guide tracks 204, 206 are fixed to the base 34 in an oblique orientation (e.g., askew) with respect to the vertical axis V when the support frame 36 is at the minimum height or the maximum height. In other embodiments, the guide tracks 204, 206 are arranged parallel to the longitudinal axis L, i.e., not obliquely relative to the vertical axis V. The guide tracks 204, 206 comprise guide slots 210 similar to the prior embodiments. It should be appreciated that the guide tracks 204, 206 could be arranged in any suitable orientation.

Figure 9:
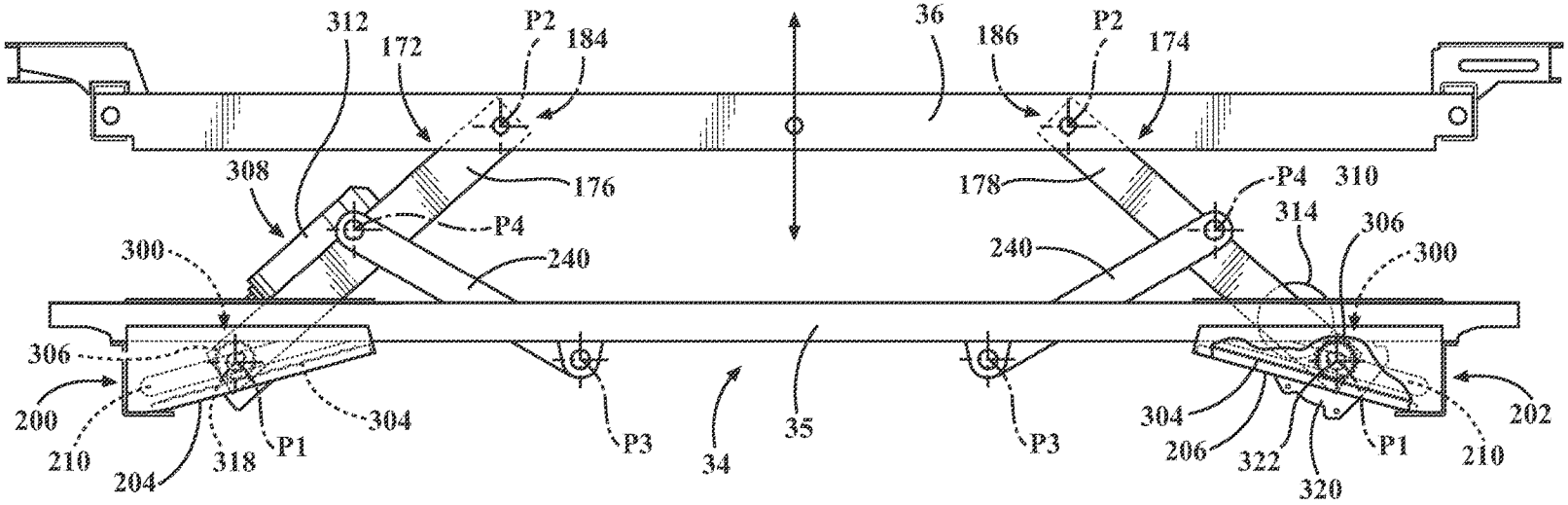
FIG. 9 is an elevational view of the alternative lift assembly.
Figure 10:
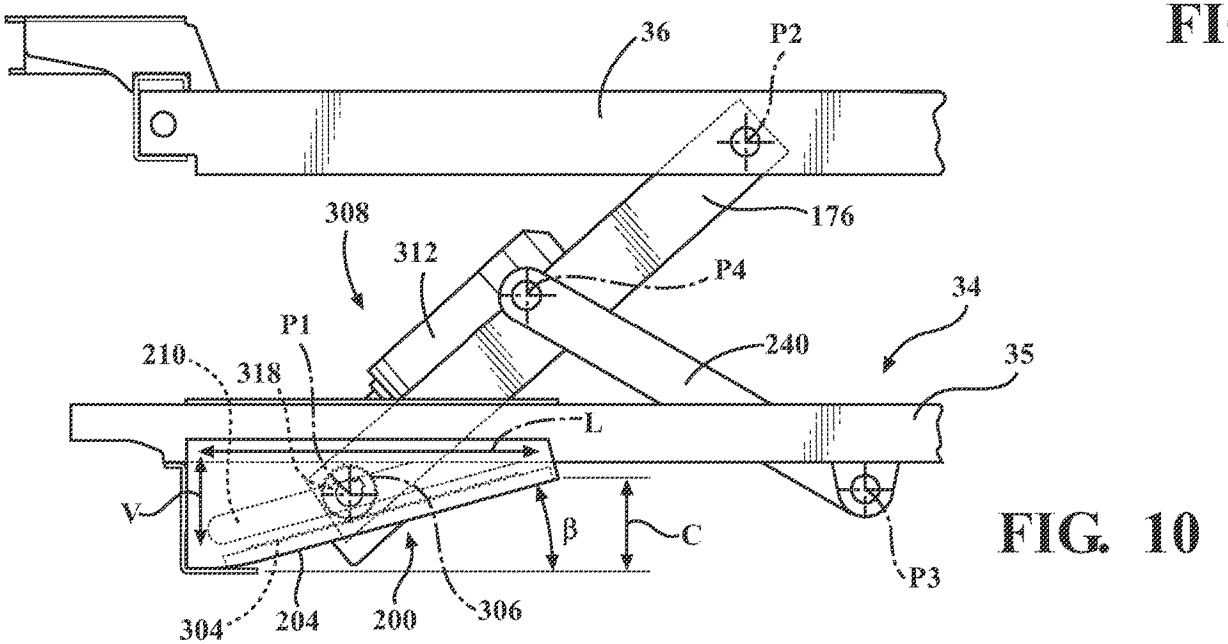
FIG. 10 is a close-up elevational view of a portion of the alternative lift assembly.

Referring to FIGS. 9 and 10, the driven members 300 are coupled to the lift members 172, 174 to move the lift members 172, 174. The driven members 300 are rotatable relative to the lift members 172, 174 about movable lower pivot axes P1. In the embodiment shown, the guides 200, 202 comprise racks 304 and the driven members 300 comprise drive gears 306 movable along the racks 304, such as in a rack and pinion arrangement, in order to extend or collapse the lift members 172, 174 to lift or lower the support frame 36. The racks 304 are fixed in position relative to the base 34. In other embodiments, the racks 304 may be movable via a separate actuator (not shown) to further enhance the range between the maximum height and the minimum height. In another embodiment, the guides 200, 202 comprise frictional engagement surfaces and the driven members 300 comprise drive wheels rollable along the frictional engagement surfaces. Other types of driven members are also contemplated.

The rotary actuators 308, 310 are operatively coupled to the driven members 300 to rotate the driven members 300 relative to the lift members 172, 174. In the embodiment shown, a first rotary actuator 308 comprises a first motor 312 operatively coupled to a head end pair of the driven members 300. A second rotary actuator 310 comprises a second motor 314 operatively coupled to a foot end pair of the driven members 300. The head end pair of the driven members 300 are rotatably mounted to the head end lift member 172. The foot end pair of the driven members 300 are rotatably mounted to the foot end lift member 174. In the embodiment shown, the motors 312, 314 rotate the driven members 300 relative to the lift members 172, 174 to travel along the racks 304, which causes the lift members 172, 174 to lift and lower the support frame 36 relative to the base 34. In other embodiments, the motors 312, 314 may drive the driven members 300 in alternative ways to cooperate with the guides 200, 202 to cause the lift members 172, 174 to lift and lower the support frame 36 relative to the base 34.

Referring to FIGS. 8-10, in the embodiment shown, the first actuator 308 comprises a gearbox 316 (see FIG. 8) to which the first motor 312 is operatively coupled. The gearbox 316 may be a high ratio gearbox, such as one providing a ratio of 60:1 or greater. The gearbox 316 converts rotary motion of the first motor 312 into rotation of a first drive shaft 318 (see FIG. 9) fixed to the head end pair of the driven members 300 to rotate the associated drive gears 306 along the associated racks 304. The first drive shaft 318 is rotatably supported in a support arm 183 (see FIG. 8) that interconnects the pair of the head end lifts legs 176. The first drive shaft 318 is fixed at each end to the associated drive gears 306 through the slots 210 in the head end guide tracks 204. The first drive shaft 318 has a diameter with little clearance in the slots 210 so that the slots 210 constrain movement of the first drive shaft 318 to keep the drive gears 306 in contact with the racks 304, as shown in FIG. 10. The first motor 312 and the gearbox 316 are fixed to the pair of head end lift legs 176 via a cross member 315 (see FIG. 8). As a result, during operation of the first motor 312, the first motor 312 and the gearbox 316 move with the head end lift member 172.

The second actuator 310 comprises a transaxle transmission 320 to which the second motor 314 is operatively connected to form a transaxle motor arrangement. The transaxle transmission 320 is connected to a second drive shaft 322 (see FIG. 9) fixed to the foot end pair of the driven members 300 to rotate the associated drive gears 306 along the associated racks 304. The second drive shaft 322 is rotatably supported in a support arm 185 that interconnects the pair of the foot end lifts legs 178. The second drive shaft 322 is fixed at each end to the associated drive gears 306 through the slots 210 in the foot end guide tracks 206. The second drive shaft 322 has a diameter with little clearance in the slots 210 so that the slots 210 constrain movement of the second drive shaft 322 to keep the drive gears 306 in contact with the racks 304. The second motor 314 and the transaxle transmission 320 are fixed to the pair of foot end lift legs 178 via a cross member 315 (see FIG. 8). As a result, during operation of the second motor 314, the second motor 314 and the transaxle transmission 320 move with the foot end lift member 174.

Timing links 240 are pivotally connected at a first end to the lift legs 176, 178 and pivotally connected at a second end to the base frame 35. In particular, in the embodiment shown, the timing links 240 are pivotally connected to the base frame 35 to pivot about a third pivot axis P3 and are pivotally connected to the lift legs 176, 178 to pivot about a fourth pivot axis P4. Timing links 240 could also be pivotally connected to only one of the lift legs 176, 178 in other embodiments. The timing links 240 constrain movement of the lift legs 176, 178 during lifting and lowering so that, when the rotary actuators 308, 310 are operated simultaneously to lift and lower the support frame 36, the head end and the foot end of the support frame 36 are lifted and lowered evenly relative to the base 34 without any relative longitudinal motion between the support frame 36 and the base 34. The rotary actuators 308, 310 can also be operated independently to place the support frame 36 in a Trendelenburg or reverse Trendelenburg position.

In other embodiments, separate actuators may be operatively coupled to each of the driven members 300. Such actuators may each comprise a motor configured to separately rotate separate drive shafts operatively connected to each of the drive gears 306. As a result, the separate actuators are capable of independently driving each of the driven members 300 to lift and lower the support frame 36 relative to the base 34. In yet other embodiments, instead of different actuators 308, 310 being used to drive the driven members 300, the same actuators 308 or 310 could be used to drive the driven members 300, or any other suitable actuators could be employed.

During operation of the alternative lift assembly 170, when a user wishes to move the support frame 36 relative to the base 34, the user actuates one or more of the user input devices. For instance, in the event the user wishes to lower the support frame 36 relative to the base 34, the user actuates the appropriate user input device. Upon actuation, the controller sends output signals to the actuators 308, 310 to cause operation of the actuators 308, 310 in a manner that causes the support frame 36 to lower. In the embodiment shown, this includes both of the motors 312, 314 being commanded by the controller to operate through the gearbox 316 and the transaxle transmission 320, respectively, to rotate the drive shafts 318, 322 in the support arms 183, 185 thereby rotating the gears 306. The motors 312, 314 are operated so that the gears 306 associated with the head end pair of the driven members 300 ride along their associated racks 304 toward the head end and the gears 306 associated with the foot end pair of the driven members 300 ride along their associated racks 304 toward the foot end. As a result, owing to the pivotal connection of the lift members 172, 174 to the support frame 36 at the fixed upper pivot axes P2, when the head end and foot end pairs of the driven members 300 are driven away from each other in the guide tracks 204, 206, the lift members 172, 174 begin to collapse and the support frame 36 is lowered relative to the base 34.

Due to the oblique orientation of the guide tracks 204, 206 relative to the vertical axis V, as the head end and foot end pairs of the driven members 300 move away from each other, the driven members 300 are guided in the guide tracks 204, 206 such that the driven members 300 move both longitudinally and vertically, up to the entire longitudinal distance L1 and the vertical distance V1. More specifically, the driven members 300 that are coupled to the head end lift member 172 move longitudinally toward the head end of the base 34 and the driven members 300 that are coupled to the foot end lift member 174 move longitudinally toward the foot end of the base 34, while all of the driven members 300 move equally vertically downward. By guiding the driven members 300, 302 to move vertically downward, the lift members 172, 174 are lowered, thereby further lowering the support frame 36 to which lift members 172, 174 are pivotally constrained. This provides an even lower minimum height of the support frame 36 than could otherwise be accomplished if the guide tracks 204, 206 were merely arranged longitudinally along the base, e.g., not oblique. In other embodiments, however, the guide tracks 204, 206 are arranged longitudinally along the base, such that there is no vertical component of relative motion between the lift members 172, 174 and the base 34, i.e., the driven members 300 are only guided to move longitudinally, not vertically. The driven members 300 could be driven in other possible paths in other embodiments, such as curvilinear paths, tortuous paths, linear paths, or the like.

Figure 11:
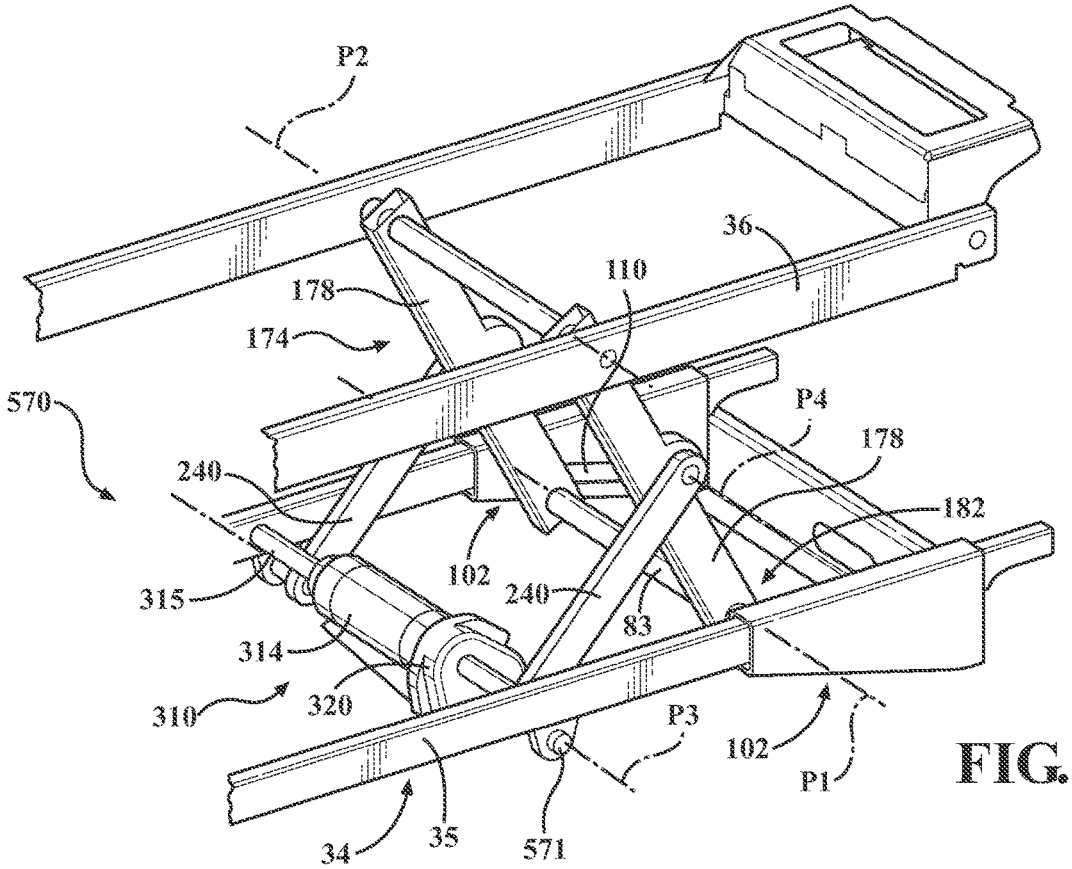
FIG. 11 is a partial perspective view of an alternative lift assembly.

Referring to FIG. 11, an alternative lift assembly 570 is shown, which shares features of both of the previously described lift assemblies 70, 170. Like the lift assemblies 70, 170, the alternative lift assembly 570 has a pair of lift members that lift and lower the support frame 36 relative to the base 34. For simplicity, only the lift member 174 is shown. The lift members comprise head end lift legs (not shown) and foot end lift legs 178. Timing links 240, like those in the lift assembly 170, are also present. The lift assembly 570 employs the guides 100, 102 and guided bodies 108 of the lift assembly 70. Only the guides 102 are shown and the guided bodies 108 are obstructed from view.

In this lift assembly 570, the actuators that move the lift legs 178 to lift and lower the support frame 36 relative to the base 34 are the same as the second actuator 310 of the lift assembly 170 and comprises the transaxle transmission 320 to which the second motor 314 is operatively connected to form a transaxle motor arrangement. In this embodiment, the transaxle transmission 320 is connected to a drive shaft 571 fixed to the timing links 240 to rotate the timing links 240 about the pivot axis P3. The second motor 314 and the transaxle transmission 320 are shown fixed to the base frame 35 via a cross member 315 so that as the second actuator 310 operates to rotate the drive shaft 571, the drive shaft 571 rotates relative to the base frame 35 about pivot axis P3. This movement causes the other end of the timing links 240 to pivot about the pivot axis P4 relative to the lift legs 178. This, in turn, pivots the lift legs 178 about the fixed upper pivot axes P2 and causes the guided bodies 108 to move longitudinally and vertically in the guides 100, 102.

Figure 12:
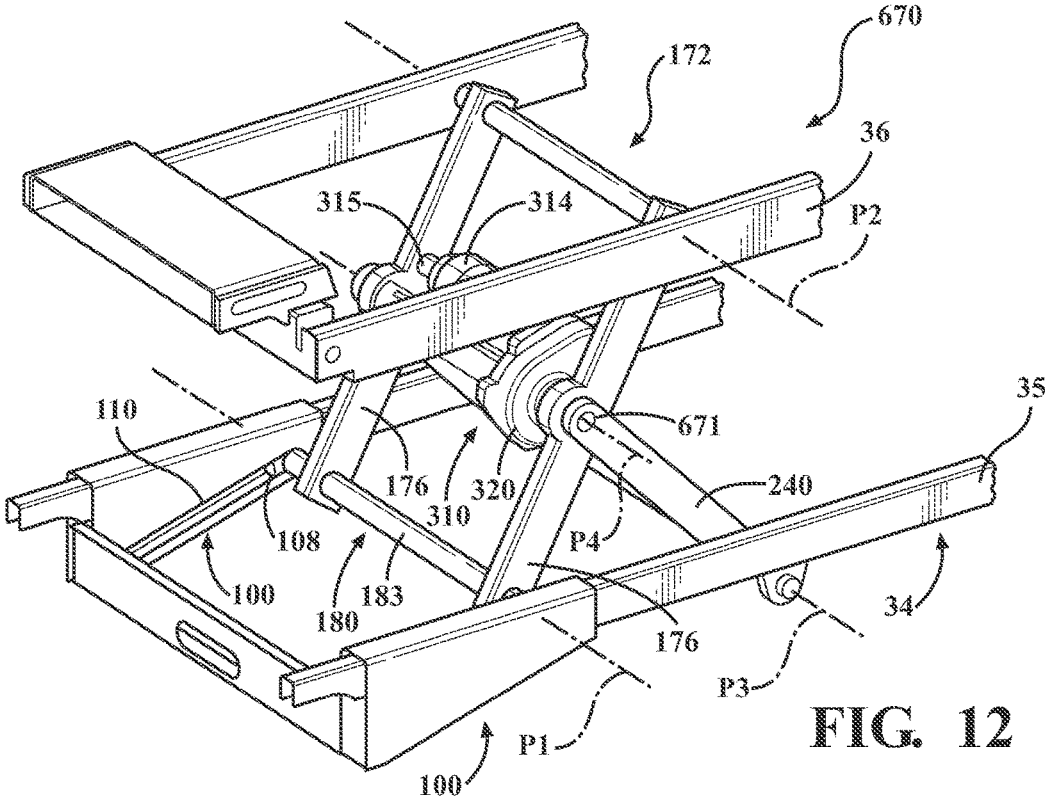
FIG. 12 is a partial perspective view of an alternative lift assembly.

Referring to FIG. 12, an alternative lift assembly 670 is shown, which shares features of both of the previously described lift assemblies 70, 170. Like the lift assemblies 70, 170, the alternative lift assembly 670 has a pair of lift members that lift and lower the support frame 36 relative to the base 34. For simplicity, only the lift member 172 is shown. The lift members comprise head end lift legs 176 and foot end lift legs (not shown). Timing links 240, like those in the lift assembly 170, are also present. The lift assembly 670 employs the guides 100, 102 and guided bodies 108 of the lift assembly 70. Only the guides 100 are shown.

In this lift assembly 670, the actuators that move the lift legs 176 to lift and lower the support frame 36 relative to the base 34 are the same as the second actuator 310 of the lift assembly 170 and comprise the transaxle transmission 320 to which the second motor 314 is operatively connected to form a transaxle motor arrangement. In this embodiment, the transaxle transmission 320 is connected to a drive shaft 671 fixed to the timing links 240 to rotate the timing links 240 about the pivot axis P4. The second motor 314 and the transaxle transmission 320 are shown fixed to the head end lift legs 176 via a cross member 315 so that as the second actuator 310 operates to rotate the drive shaft 671, the drive shaft 671 rotates relative to the head end lift legs 176 about pivot axis P4. This movement causes the other end of the timing links 240 to pivot about the pivot axis P3 relative to the base frame 35. This, in turn, pivots the lift legs 176 about the fixed upper pivot axes P2 and causes the guided bodies 108 to move longitudinally and vertically in the guides 100, 102.

Figure 13:
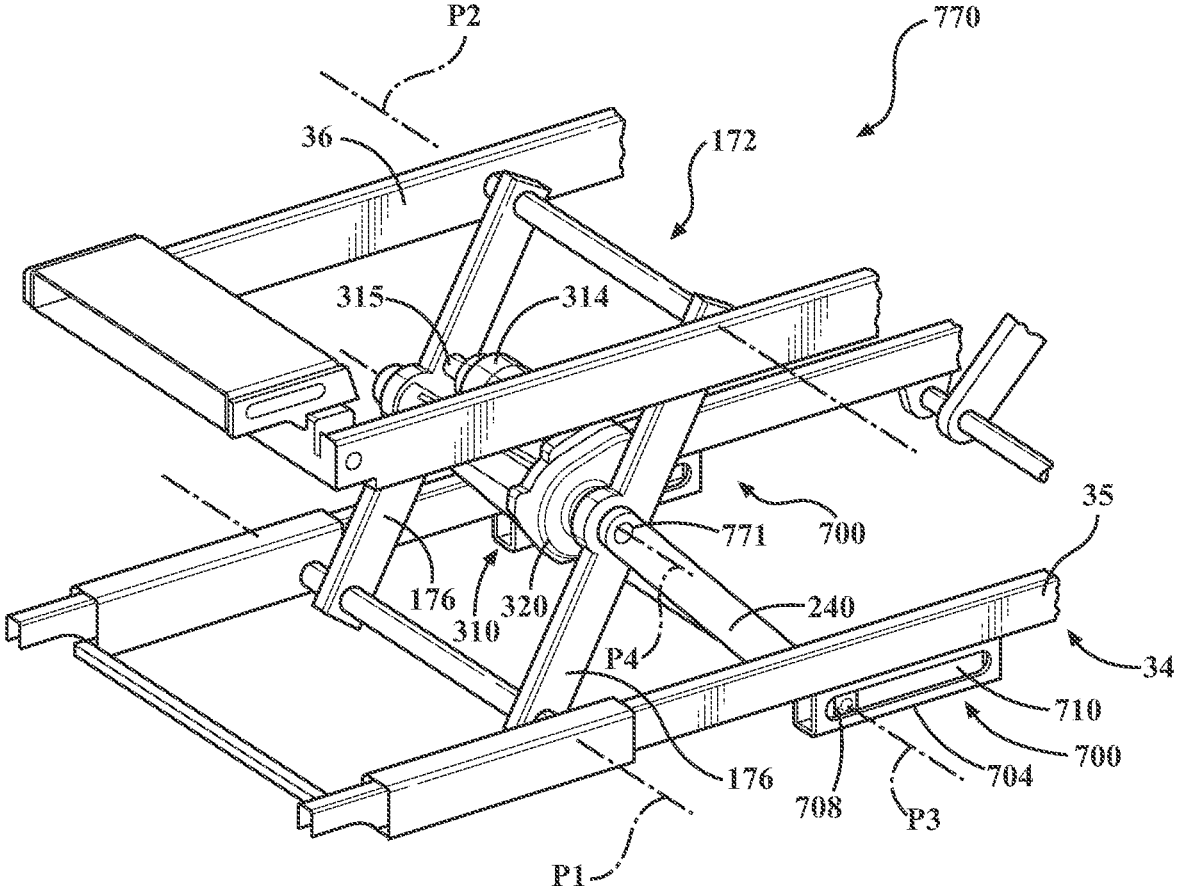
FIG. 13 is a partial perspective view of an alternative lift assembly.

Referring to FIG. 13, an alternative lift assembly 770 is shown, which shares features of both of the previously described lift assemblies 70, 170. Like the lift assemblies 70, 170, the alternative lift assembly 770 has a pair of lift members that lift and lower the support frame 36 relative to the base 34. For simplicity, only the lift member 172 is shown. The lift members comprise head end lift legs 176 and foot end lift legs (not shown). Timing links 240, like those in the lift assembly 170, are also present.

In this embodiment, the lift assembly 770 employs guides 700 and guided bodies 708. The guides 700 comprise a pair of head end guide tracks 704 and a pair of foot end guide tracks (not shown). In this lift assembly 770, the guide tracks 704 are fixed to the base frame 35 in a more central location to cooperate with the guided bodies 708. In this embodiment, the guided bodies 708 are rotatably connected to one end of each of the timing links 240 (only one shown). Additionally, the first ends of the lift legs 176 are now pivotally connected to the base 34 at fixed pivot axes P1, unlike the prior embodiments in which the pivot axes P1 were movable. Likewise, the pivot axes P3 are now movable along the guides 700, as opposed to being fixed. In this embodiment, the guides 700 may be placed in any suitable orientation to cause lifting and lowering of the support frame 36 relative to the base 34.

In this lift assembly 770, the rotary actuators 310 move the lift legs 176 to lift and lower the support frame 36 relative to the base 34. These rotary actuators 310 are the same as the second actuator 310 of the lift assembly 170. Like in the lift assembly 170, each of the actuators 310 comprises a transaxle transmission 320 to which a motor 314 is operatively connected to form a transaxle motor arrangement. In this embodiment, the transaxle transmission 320 is connected to a drive shaft 771 fixed to the timing links 240 to rotate the timing links 240 about the pivot axis P4.

The motor 314 and the transaxle transmission 320 are shown fixed to the head end lift legs 176 via a cross member 315 so that as the actuator 310 operates to rotate the drive shaft 771, the drive shaft 771 rotates relative to the head end lift legs 176 about pivot axis P4. This movement causes the other end of the timing links 240 to pivot about the pivot axis P3, while the pivot axis P3 moves along the guides 700 via the guided bodies 708 relative to the base frame 35. This, in turn, pivots the lift legs 176 about the fixed upper pivot axes P2 and causes the lift legs 176 to extend or collapse relative to the base 34.

In additional embodiments (not shown), the components of the lift assemblies 170, 570, 670, 770 could be reversed, i.e., those coupled to the base 34, instead coupled to the support frame 36, and those coupled to the support frame 36, instead coupled to the base 34.

It will be further appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient support apparatus comprising:

a support structure comprising a base and a support frame;

a lift assembly to move said support frame relative to said base in a vertical direction, said lift assembly comprising a lift member having a first end section movably coupled to said base for movement relative to said base during the lifting or lowering of said support frame and a second end section pivotally connected to said support frame at a fixed pivot axis for pivoting relative to said support frame;

a timing link pivotally connected at a first end to one of said lift members and pivotally connected at a second end to said base; and a guide fixed to said base and arranged to guide the movement of said first end section of said lift member when said lift member pivots about said fixed pivot axis, said guide configured so that said first end section is displaced in said vertical direction relative to said base while being guided by said guide in order to lift or lower said lift member relative to said base in said vertical direction.

2. The patient support apparatus of claim 1, wherein said guide is obliquely oriented relative to said base so that said first end section of said lift member is displaced relative to said base in both said vertical direction and a longitudinal direction along said base during lifting or lowering of said support frame.

3. The patient support apparatus of claim 1, wherein said lift assembly is configured to move said support frame from a minimum height to a maximum height.

4. The patient support apparatus of claim 3, wherein said guide is askew when said support frame is at said minimum height or said maximum height.

5. The patient support apparatus of claim 3, wherein said guide is oriented with respect to said vertical direction when said support frame is at said minimum height such that clearance of at least five inches is provided between at least a portion of said guide and a floor surface.

6. The patient support apparatus of claim 3, comprising a second guide and a second lift member, said second lift member having a first end section movably coupled to said base and a second end section pivotally connected to said support frame at a fixed pivot axis.

7. The patient support apparatus of claim 6, wherein said lift members comprise a pair of head end lift legs and a pair of foot end lift legs.

8. The patient support apparatus of claim 6, wherein said lift assembly comprises:

a first actuator coupled to one of said lift members and a second actuator coupled to the other of said lift members, said actuators configured to pivot said lift members about said fixed pivot axes to lift or lower said support frame relative to said base;

a first actuator mount fixed to said one of said lift members wherein said first actuator has a first end pivotally connected to said support frame and a second end pivotally connected to said first actuator mount; and a second actuator mount fixed to the other of said lift members wherein said second actuator has a first end pivotally connected to said support frame and a second end pivotally connected to said second actuator mount.

9. The patient support apparatus of claim 3, wherein said support frame is arranged to contact said base when said support frame is at said minimum height.

10. The patient support apparatus of claim 1, wherein said base comprises a base frame and said guide is fixed to said base frame so that one end of said guide extends below said base frame.

11. The patient support apparatus of claim 1, wherein said guide comprises a slide-bearing guide track and said lift assembly comprises a block slidable along said slide-bearing guide track.

12. The patient support apparatus of claim 1, wherein said guide comprises a rack and said lift assembly comprises a gear movable along said rack.

13. A patient support apparatus comprising:

a support structure comprising a base and a support frame;

a lift assembly to lift or lower said support frame relative to said base, said lift assembly comprising an actuator and a lift member having a first end section movably coupled to one of said base and said support frame for movement relative to said one of said base and said support frame during the lifting and lowering of said support frame and a second end section pivotally connected to the other of said base and said support frame at a fixed pivot axis for pivoting relative to the other of said base and said support frame, wherein said lift assembly is configured to move said support frame from a minimum height to a maximum height;

a timing link pivotally connected at a first end to one of said lift members and pivotally connected at a second end to said base; and a guide fixed to said one of said base and said support frame and arranged to guide the movement of said first end section with respect to said one of said base and said support frame when said lift member pivots about said fixed pivot axis;

wherein said lift assembly comprises a driven member configured to be driven by said actuator, said driven member engaging said guide and configured to cooperate with said guide to lift or lower said support frame relative to said base.

14. The patient support apparatus of claim 13, comprising a second lift member, a second guide, a second actuator, and a second driven member configured to be driven by said second actuator, said second lift member having a first end section movably coupled to said one of said base and said support frame and a second end section pivotally connected to the other of said base and said support frame, said second guide arranged to guide the movement of said first end section of said second lift member, and said second driven member engaging said second guide and configured to cooperate with said second guide to lift or lower said support frame relative to said base.

15. The patient support apparatus of claim 14, wherein said second end sections of said lift members are pivotally connected at said fixed pivot axes such that said fixed pivot axes lie in a common plane perpendicular to a vertical axis when said support frame is at said minimum height or said maximum height.

16. The patient support apparatus of claim 14, wherein said first end sections of said lift members are configured to move toward one another as said support frame is lifted relative to said base and said first end sections are configured to move away from one another as said support frame is lowered relative to said base.

17. The patient support apparatus of claim 13, wherein said guide comprises a guide track having a guide slot.

18. The patient support apparatus of claim 13, wherein said driven member is coupled to said lift member; and wherein said driven member and is rotatable relative to said lift member.

19. The patient support apparatus of claim 13, wherein said driven member is coupled to said lift member; and wherein said guide comprises a rack and said driven member comprises a drive gear movable along said rack.

20. The patient support apparatus of claim 13, wherein said driven member is coupled to said lift member; and wherein said actuator comprises a motor operatively coupled to said driven member to rotate said driven member relative to said lift member.

* * * * *